US009795257B1

(12) United States Patent
June

(10) Patent No.: US 9,795,257 B1
(45) Date of Patent: Oct. 24, 2017

(54) WALL-MOUNTABLE HANDS-FREE BACK WASHER

(71) Applicant: Minnie D. June, Coral Springs, FL (US)

(72) Inventor: Minnie D. June, Coral Springs, FL (US)

( * ) Notice: Subject to any disclaimer, the term of this patent is extended or adjusted under 35 U.S.C. 154(b) by 0 days.

(21) Appl. No.: 15/172,125

(22) Filed: Jun. 2, 2016

(51) Int. Cl.
*A47K 7/02* (2006.01)

(52) U.S. Cl.
CPC ..... *A47K 7/024* (2013.01)

(58) Field of Classification Search
CPC ..... A47K 7/024; A47K 7/02; A47K 7/022; A47L 13/16
USPC .... 15/224.1, 119.2, 209.1, 121, 210.1, 244.3
See application file for complete search history.

(56) References Cited

U.S. PATENT DOCUMENTS 3,055,037 A * 9/1962 Fjelstad ..... A47K 7/024 15/210.1
4,417,362 A * 11/1983 Walker ..... A47K 7/024 15/160
5,175,896 A * 1/1993 Zamir ..... A47K 7/024 15/160
5,933,909 A * 8/1999 Keating ..... A47K 7/024 15/244.1
6,370,722 B1 * 4/2002 Duckworth ..... A47K 7/024 15/104.92
7,467,438 B2 * 12/2008 Ryman ..... A47K 7/024 15/160
8,505,551 B2 * 8/2013 Moretti ..... A47K 7/026 132/200
2002/0117185 A1 * 8/2002 Simon ..... A47K 7/024 134/6
2006/0010630 A1 * 1/2006 Tse ..... A61H 7/003 15/160

* cited by examiner

*Primary Examiner* — Monica Carter
*Assistant Examiner* — Stephanie Berry

(57) ABSTRACT

A wall-mountable hands-free back washer that allows users to wash and exfoliate their backs without using their hands. The back washer is mounted on a shower wall or bathtub wall by a support panel that attaches to a shower or bathtub wall. The support panel may be permanently for removably attached to the wall. Sponges are attached to the support panel. The sponges can be loofah sponges or any other suitable type of sponge or exfoliating device. The sponges are mounted on the support panel such that a user only has to lean back against the back washer and move up-and-down or side-to-side to clean the user's back.

15 Claims, 11 Drawing Sheets

WALL-MOUNTABLE HANDS-FREE BACK WASHER

CROSS-REFERENCE TO RELATED APPLICATIONS

This application is related to, and claims the benefit of, the provisional patent application entitled "Wall-Mountable Hands-Free Back Washer", filed Dec. 6, 2015, bearing U.S. Ser. No. 62/264,467 and naming Minnie D. June, the named inventor herein, as sole inventor, the contents of which is specifically incorporated by reference herein in its entirety.

BACKGROUND

Technical Field

This invention relates in general to accessories for bathing and showering. In particular, it relates to a back washer with a scrubbing surface that can be mounted on a shower wall such that individuals can wash their backs hands-free.

Background of the Invention

For most individuals, showering is a quick and easy way to wash in a minimal amount of time. However, it is difficult for some people to clean their backs for the simple reason that they cannot easily reach all parts of their back. This is especially true for individuals who may be disabled, or suffer from common ailments senior citizens have, such as arthritis, etc. It would be desirable to have a way for elderly or disabled people to conveniently wash their backs while bathing.

The prior art has attempted to address this problem by providing some solutions. For example, commercially available brushes, similar to a back scratcher, allow individuals to reach hard to get at spots on their backs. Likewise, there are straps made of loofah or other suitable material that allow an individual to hold both ends of the strap and use it to exfoliate the skin on their back. However, if this does not help an individual who is disabled and cannot use their hands to control one of these devices.

While the prior art has provided some solutions that work for able-bodied individuals that do not have any handicaps, it has failed to provide a way for disabled individuals to clean and exfoliate their backs. It would be desirable to have a device that anyone can use to clean their back, whether they are disabled or not.

SUMMARY OF THE INVENTION

The invention provides a wall-mountable hands-free back washer (hereinafter "back washer") that overcomes the disadvantages of the prior art. The hands-free back washer can be mounted on a shower wall or bathtub wall and allows a user to wash his/her back without requiring use of his/her hands or the assistance of another individual. The hands free back washer has a support panel (the "support panel" is preferably fabricated from a soft gel material) that attaches to a shower or bathtub wall. A plurality of cleaning devices (hereinafter "sponges" or "scrubbing pads") are attached to the support panel. A plurality of exfoliating materials (e.g., sponges, loofah, etc.) are attached to one or more rigid interchangeable panels. The rigid interchangeable panels can be detached to the support panel and replaced at the user's discretion. The sponges can be loofah sponges or any other suitable type of sponge or cleaning device. The user only has to lean back against the back washer and move up-and-down, or side-to-side, to allow the sponges to clean the user's back.

DETAILED DESCRIPTION OF THE PREFERRED EMBODIMENT

Prior to a discussion of the figures, a general overview of the invention will be made.

As used herein, the terms "wall-mounted back washer" and "back washer" are used interchangeably to describe the same device. Also, the terms "sponge" and "scrubbing pad" are used interchangeably, and as used herein refer to any exfoliating material, such as a loofah pad, a wash cloth, brush bristles, bath sponge, pumice stones, an exfoliating polyester or polyester-based material, or any other suitable pad material that provides the desired cleaning and exfoliating properties.

It is to be understood that the disclosed embodiments described herein and depicted in the figures are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure.

The invention is a wall-mountable hands-free back washer for exfoliating backs. The back washer is mounted on a shower wall or bathtub wall by a support panel that attaches to a shower or bathtub wall. The support panel may be permanently for removably attached to the wall. Sponges are attached to the support panel. The sponges can be loofah sponges or any other suitable type of sponge or exfoliating device. The sponges are mounted on the support panel such that a user only has to lean back against the back washer and move up-and-down or side-to-side to clean the user's back.

Although the invention is illustrated and described herein as embodied in a wall-mountable hands-free back washer, it is understood that the invention is not intended to be limited to the details shown because various modifications and structural changes may be made therein without departing from the spirit of the invention and within the scope and range of equivalents of the claims.

Having discussed the invention in general terms, we turn now to a detailed discussion of the figures.

Figure 1:
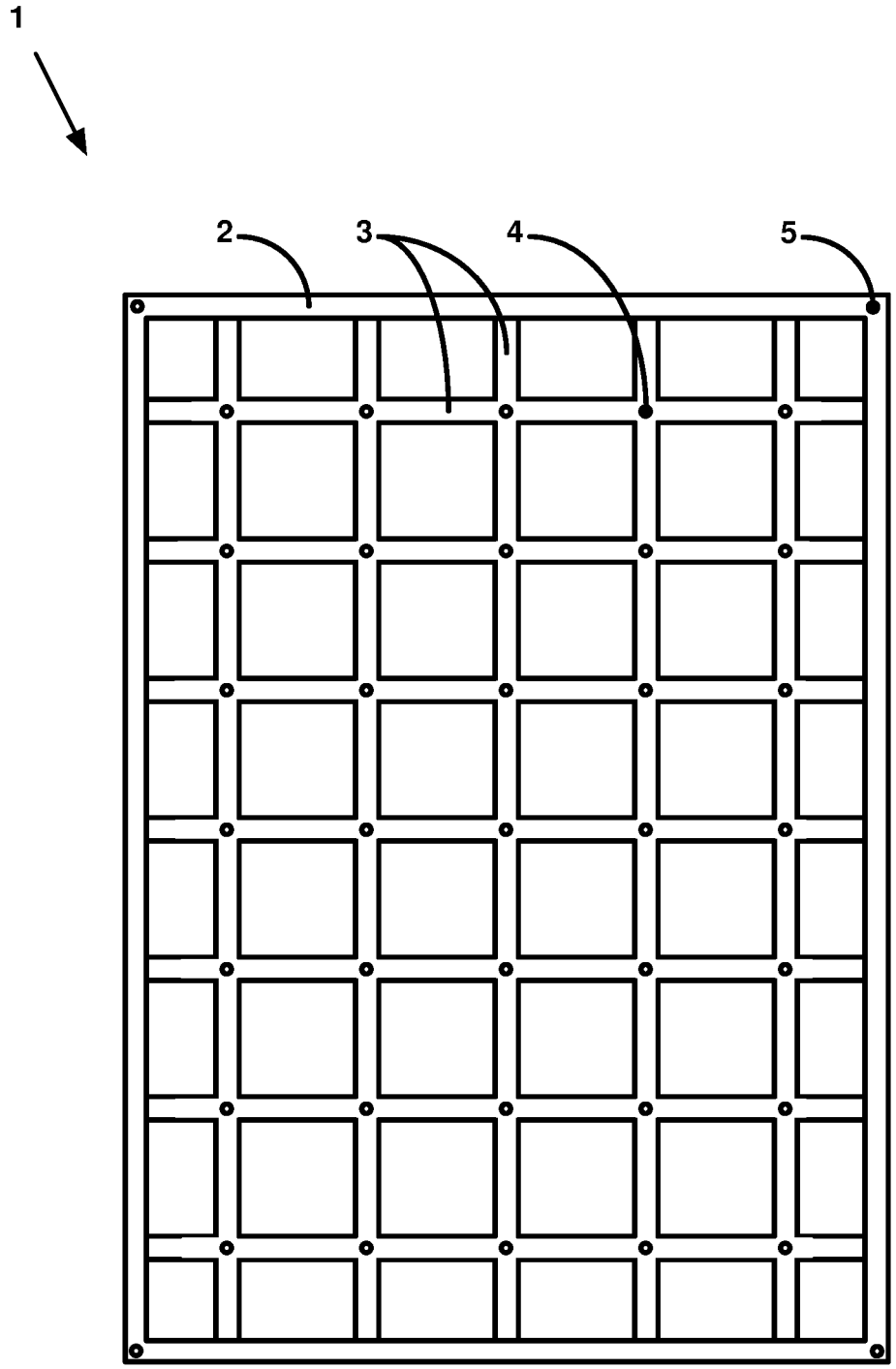
FIG. 1 illustrates a front view of a preferred embodiment of the support panel.

FIG. 1 illustrates a front view of a preferred embodiment of the support panel 1. The support panel 1 provides the structural support for the sponges 7 (discussed below in regard to FIG. 2) that the bather will use for exfoliation Those skilled in the art will recognize that the support panel 1 can be structured in any number of ways. For example, it can be a single flat-panel. However, that will add weight to the support panel 1. For that reason, the support panel 1 is fabricated using a lattice structure or a structure having apertures to reduce the overall weight. In the preferred embodiment, the support panel 1 has a peripheral edge 2 that extends around the periphery of the support panel 1, and uses vertical and horizontal braces 3 as the supports for the sponges 7. By using this open structure, the device's weight is reduced without losing any structural strength. The vertical and horizontal braces 3 are shown attached to peripheral edge 2 of the support panel 1. In practice, the peripheral edge would be covered by the sponges 7.

Preferably, the support panel 1 is fabricated from silicone, due to its suitability for use and wet environments, and non-toxicity.

The vertical and horizontal braces can be attached to the peripheral edge 2 in any suitable manner. They can be attached, depending on the materials used, via heat welding, chemical bonding, adhesives, or via mechanical means such as screws or rivets etc. However, the preferred embodiment envisions the support panel 1 being fabricated via molding process as a single piece. This reduces component counts to one, and eliminates all of the costs associated with assembling the multiple parts that would need to be done with other fabrication techniques.

Also shown in this figure our attachment points 4 that are positioned at the intersection the vertical and horizontal braces 3. Each of the attachment points 4 allows a sponge 7 to be secured at that location. The attachment points 4 can be any suitable type of fastener. For example, the attachment points 4 can be apertures where an attachments fastener, such as a prong, extends from the sponge 7 and is inserted through the attachment point 4 and secured, or it can accommodate a screw that holds the sponge 7 in place, etc.

Another element of invention includes the apertures 5 that are shown in the peripheral edge 2 of the support panel 1. Those skilled in the art will realize that the location of the aperture 5 is not critical, so long as the support panel 1 is securely mounted at the appropriate place on the wall.

Figure 2:
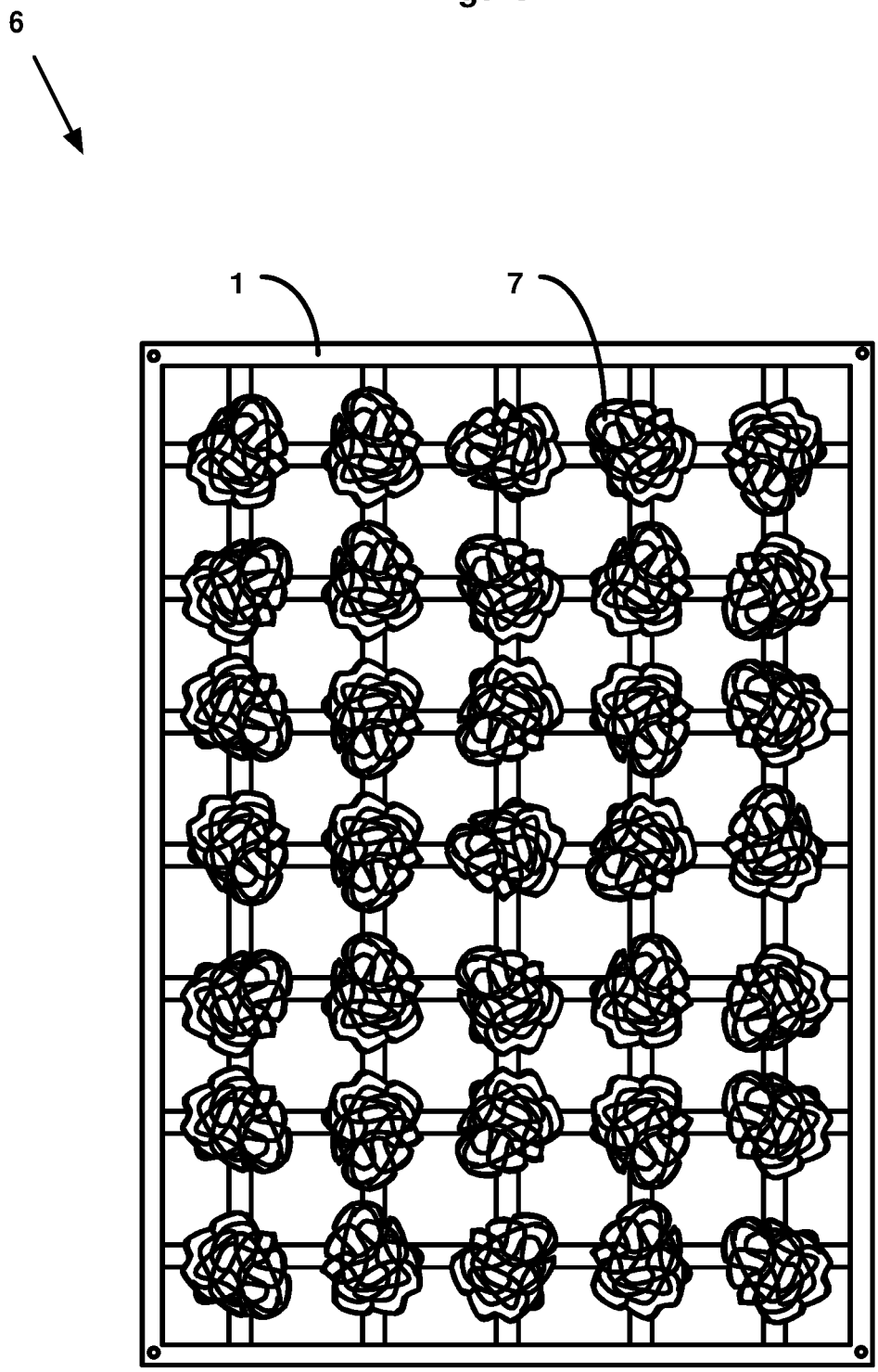
FIG. 2 illustrates a front view of a preferred embodiment of the back washer, showing a plurality of sponges attached to the support panel.

FIG. 2 illustrates a front view of a preferred embodiment of the back washer 6, showing the support panel 1 with a plurality of sponges 7 attached to it. For ease of discussion, each of the sponges 7 is illustrated separate from one another. However, the sponges 7 can have sufficient size such that they have the visual appearance of a single large sponge 7. The sponges 7 can also be arranged in any desired pattern and do not have to be organized into a rectangular grid, and can take any desired color of pattern arrangement to satisfy a desired aesthetic goal. Likewise, they can be structured to provide a substantially flat surface or an irregular surface. Of course, the back washer 6 should have sufficient size such that a typical bather can effectively clean and exfoliate their entire back.

In the preferred embodiment, the sponges 7 are fabricated from loofah sponges. However, the sponges 7 can be fabricated from any suitable material. For example, to accommodate individuals with different needs and sensitivities, a courser material such as brush bristles, pumice stone, deep exfoliating polyester, or other polymer-based material and the like.

Figure 3:
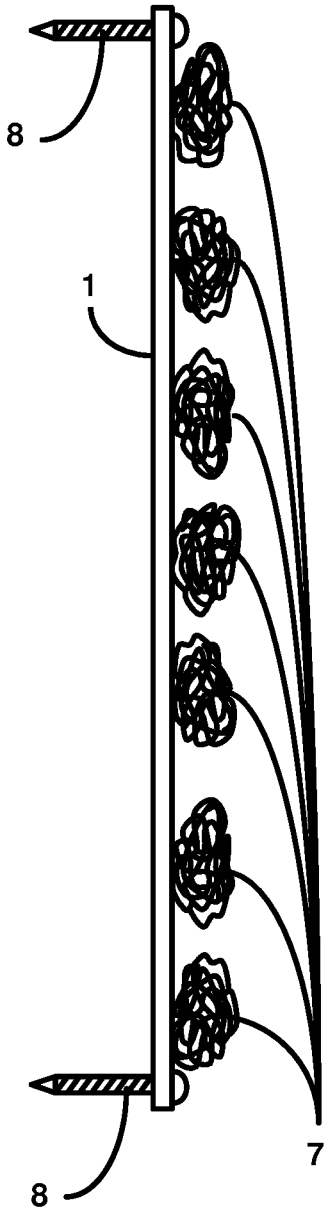
FIG. 3 illustrates a side edge view of a preferred embodiment of the back washer, showing bolts used to secure the back washer to a wall.

FIG. 3 illustrates a side edge view of a preferred embodiment of the back washer 6, showing bolts 8 used to secure the back washer 6 to a wall (not shown). Also shown in this figure is a side view of the sponges 7.

Figure 4:
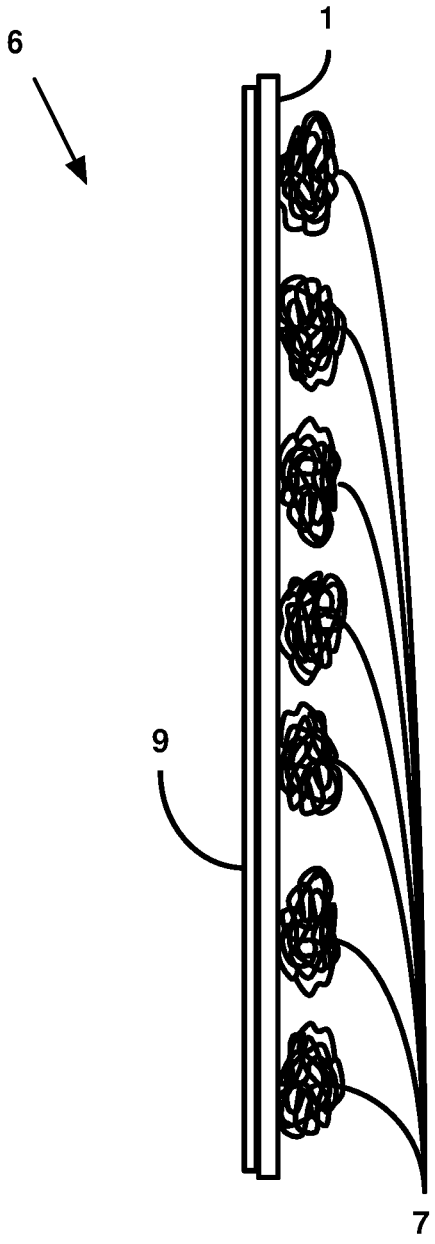
FIG. 4 illustrates a side edge view of another preferred embodiment of the back washer, showing an adhesive, or double stick tape layer that secures the back washer to a wall.

FIG. 4 illustrates a side edge view of another preferred embodiment of the back washer 6. In this embodiment, an attachment layer 9 secures the back washer 6 to a wall (not shown) instead of the bolts 8, discussed above. The attachment later 9 can be fabricated from double-sided tape, hook and loop material, or adhesive material.

Once the back washer 6 is secured to a wall, the bather only needs to lean against the back washer 6 and move up-and-down or side-to- to achieve the desired level of exfoliation. This is particularly advantageous to an individual who either cannot use their hands, or has limited use of their hands.

For ease of discussion, the invention has so far been discussed in terms of attachment to a wall in a shower stall. However, the back washer 6 can also be Incorporated into a bathtub, or bathtub wall, instead of a shower stall. Likewise, the vertical and horizontal braces 3 have been illustrated as a simple rectangular grid. Those skilled in the art will recognize that the vertical and horizontal braces 3 can be implemented in any shape, ranging from the rectangular grid shown in the illustration to ornate decorative designs to suit particular customer tastes.

The size of the back washer 6 can also very for the simple reason that individuals vary in size and what may be the perfect size for one individual might be totally inadequate for another. For that reason, it is envisioned that the back washer 6 would be made available in multiple sizes to accommodate the different sizes of individuals.

While the size of the back washer 10 is important because the size of individuals vary, the abrasiveness of the sponge is also important since the exfoliation needs of individuals also varies. A further advantage of the invention is that since the sponges 7 can be detached, and replaced with sponges having different exfoliation properties. As a result, multiple users may replace the sponges 7 to suit their particular needs.

Figure 5:
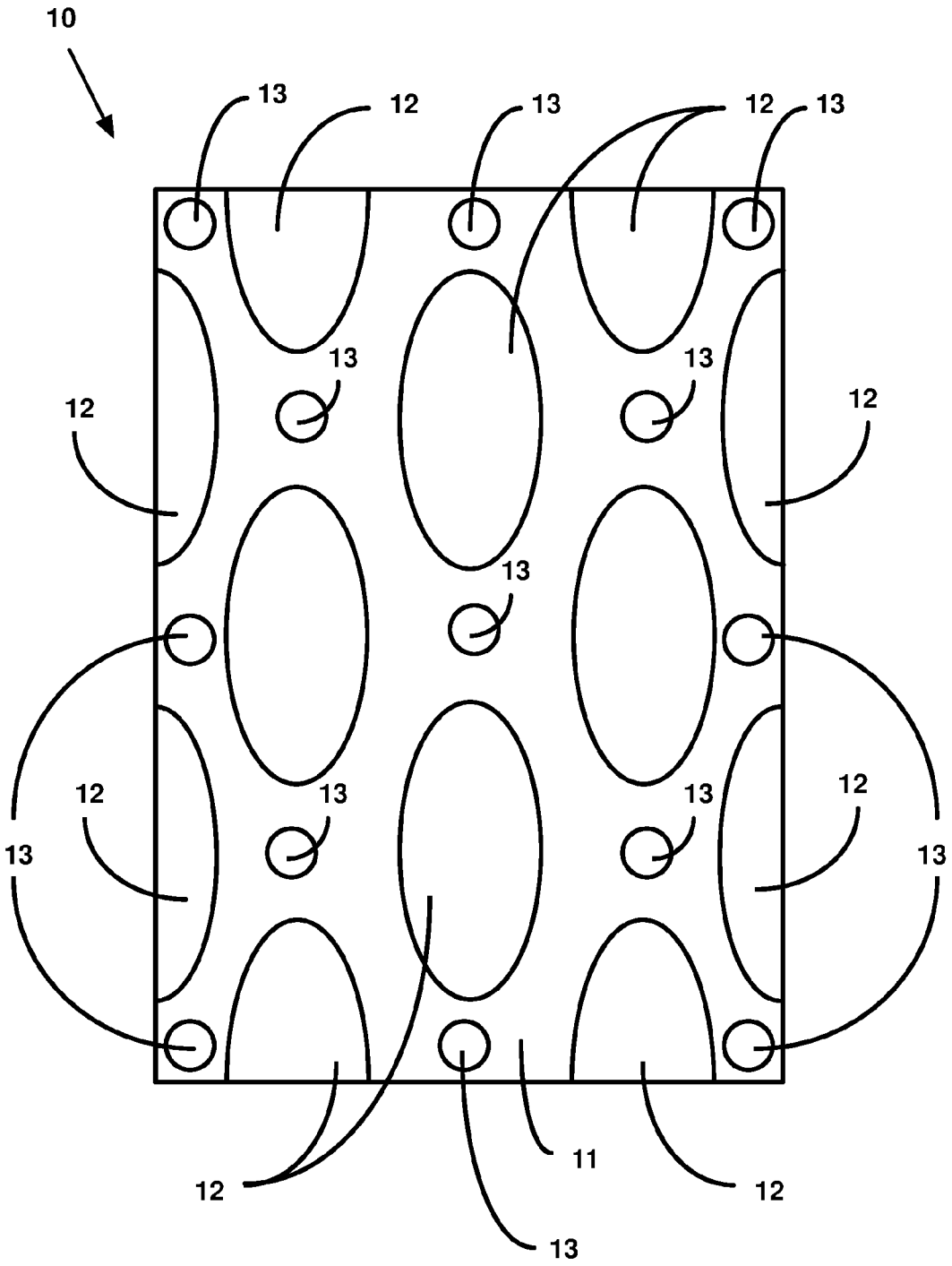
FIG. 5 illustrates an alternative preferred embodiment of the back washer. This figure illustrates the rear view of the back washer and shows a plurality of suction cups for securing the back washer to a wall.

FIG. 5 illustrates an alternative preferred embodiment of the back washer 10. This figure illustrates the rear view of the back washer 10. The back washer 10 has a rigid flat panel 11 that acts as a support for the other elements in the back washer 10. The series of apertures 12 are all arranged across the rigid flat panel 11 for the purpose of reducing weight, and thereby reducing stress on the suction cups 13. The suction cups 13 are securely attached to the rigid flat panel 11 and pressed against the wall of a shower.

In the preferred embodiment, the invention uses 13 suction cups to secure the back washer 10 to a shower wall. However, the number of suction cups 13 can vary based upon the size and weight of the back washer 10.

Figure 6:
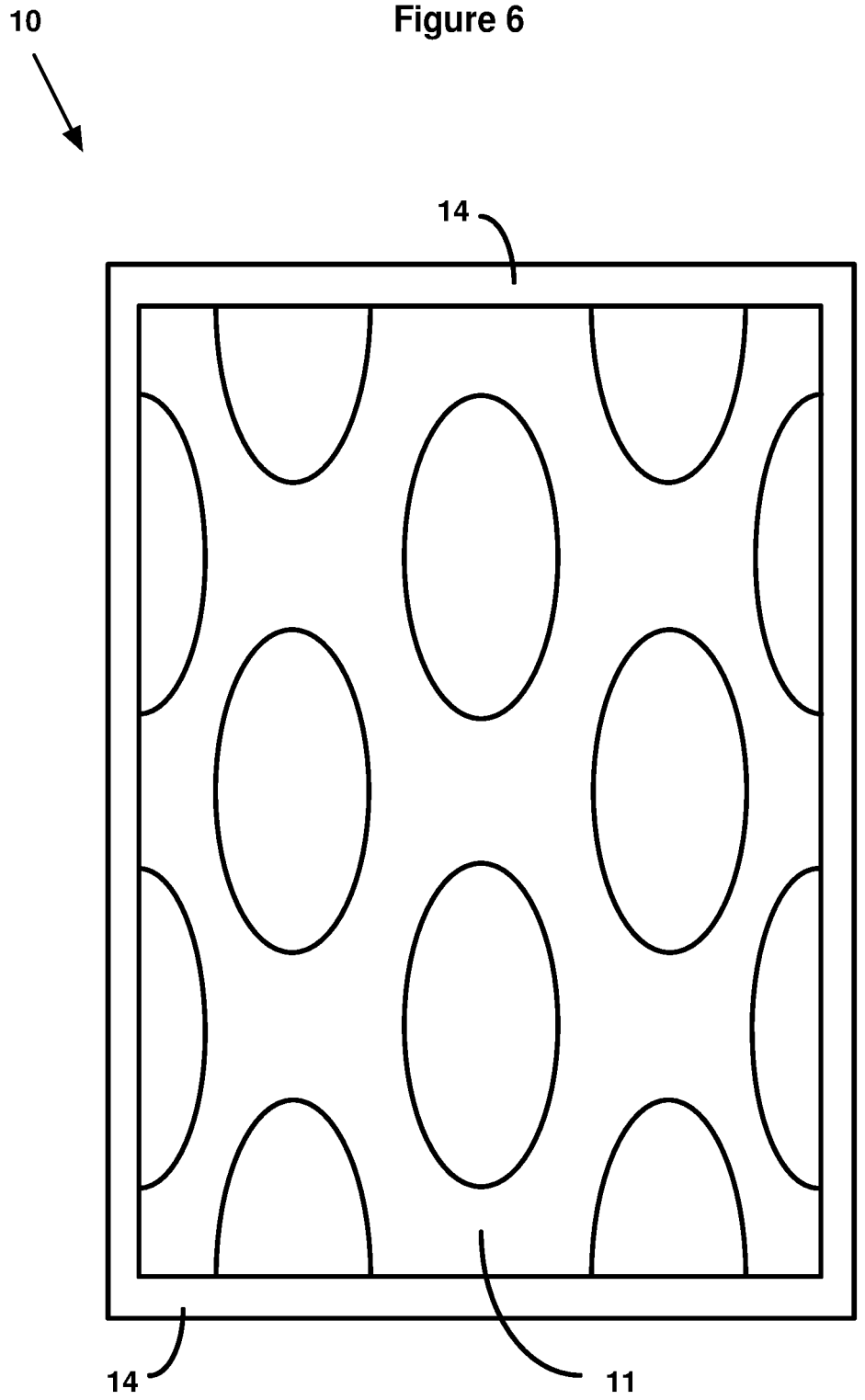
FIG. 6 illustrates a front view of the preferred embodiment of FIG. 5. This figure illustrates the front view of the back washer without a scrubbing pad installed. This embodiment will use a single scrubbing pad.

FIG. 6 illustrates an alternative preferred embodiment of the back washer 10. This figure illustrates the front view of the back washer 10 without the scrubbing pad installed. This embodiment uses a single scrubbing pad that slides into a channel 17 (shown in FIG. 8).

Channel 17 allows the scrubbing pad 15 (shown below in regard to FIG. 8) to be replaced when needed by sliding a worn scrubbing pad 15 out, and replacing it with a new scrubbing pad 15. By allowing easy replacement of the scrubbing pad 15, an individual can also change one scrubbing pad 15 for another scrubbing pad 15 that has a different level of abrasiveness. In that way, an individual can select the most desirable texture of scrubbing pad 15 for their particular needs.

Figure 7:
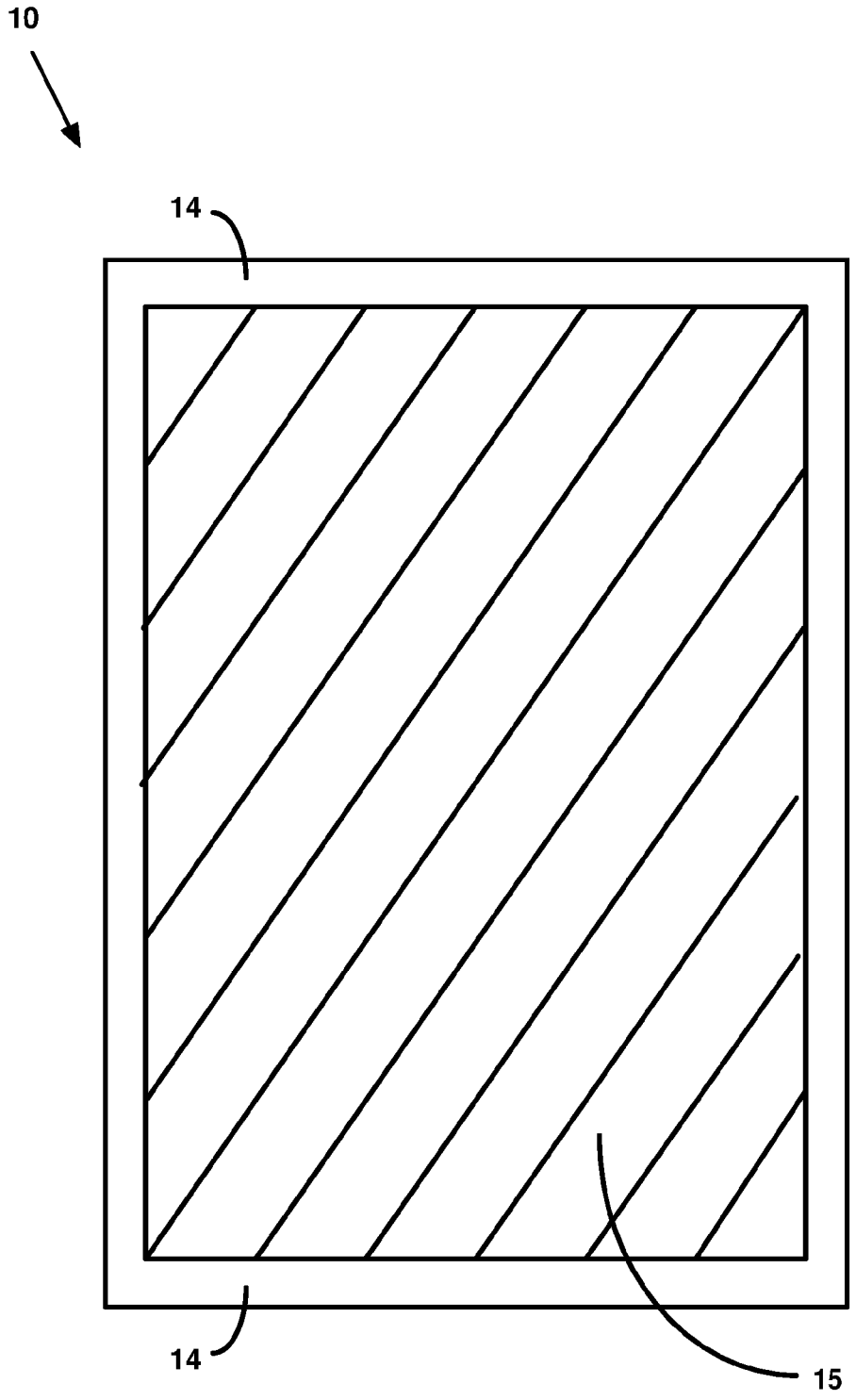
FIG. 7 illustrates an alternative preferred embodiment of the back washer with a single scrubbing pad installed on the front side of the back washer.

FIG. 7 illustrates an alternative preferred embodiment of the back washer 10 with scrubbing pad 15 installed on the front side of the back washer 10. In this embodiment, a single scrubbing pad 15 is used.

Figure 8:
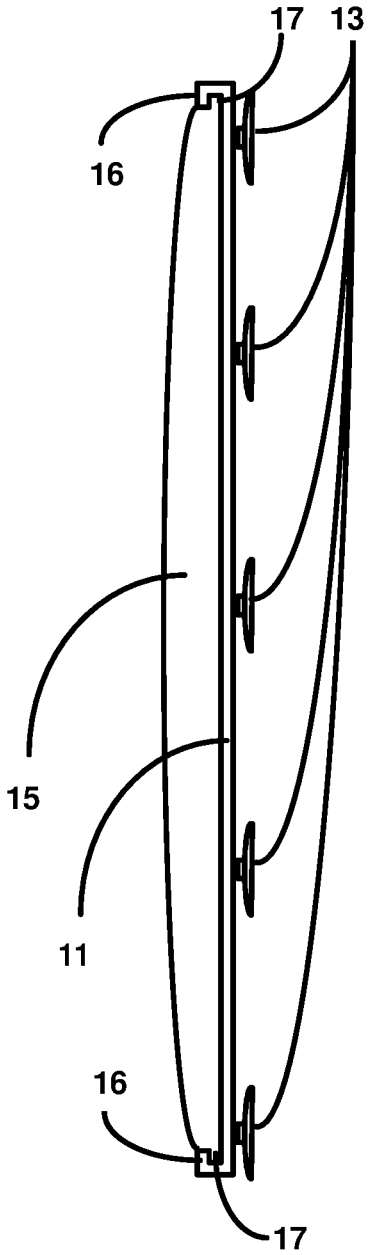
FIG. 8 illustrates a side view of the preferred embodiment of FIG. 7 with the scrubbing pad installed on the front side of the back washer, and the suction cups shown on the rear side of the back washer.

FIG. 8 illustrates a side view of an alternative preferred embodiment of the back washer 10 with the scrubbing pad 15 installed on the front side of the back washer 10. Also shown in this figure, are the suction pads 13 that would secure the back washer 10 to a shower wall. In addition, lip 16 extends out from rigid flat panel 11 to form a channel 17. The scrubbing pad 15 has a lip that is inserted into the channel 17 to secure the scrubbing pad 15 to the rigid flat panel 11. During use, an individual can scrub their back primarily leaning against the scrubbing pad 15 and moving up and down.

In this preferred embodiment, the scrubbing pad 15 has a rigid back surface with an extension that slides into channel 17 to secure the script pad 15 to the rigid flat panel 11.

Figure 9:
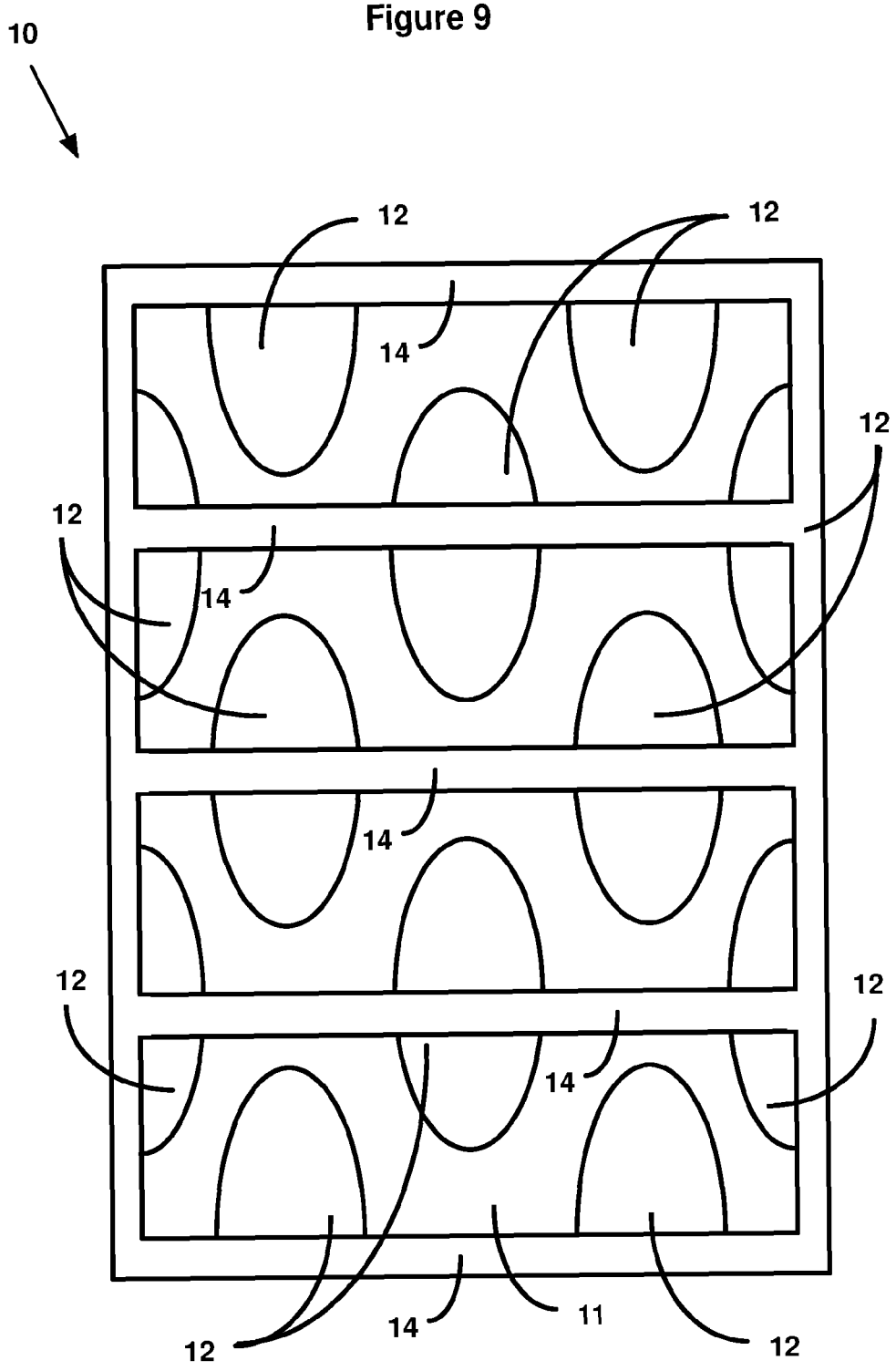
FIG. 9 illustrates an alternative preferred embodiment of the back washer. This figure illustrates the front view of the back washer without the scrubbing pads installed. This embodiment uses multiple scrubbing pads slots.

FIG. 9 illustrates yet another alternative preferred embodiment of the back washer 10. In this embodiment, multiple scrubbing pads 15 are used. This allows smaller scrubbing pads 15 to be used, and as a result, if one section of a scrubbing pad 15 is worn or damaged, a smaller section can be replaced to reduce cost. Further, this configuration also allows different types of scrubbing pads 15 to be used. For example, an individual might want a more abrasive scrubbing pad 15 near their shoulders, and a less abrasive scrubbing pad 15 near their waist. This figure illustrates the front view of the back washer 10 without the scrubbing pads installed.

This figure also illustrates multiple scrubbing pad supports 14. Each of the scrubbing pads supports 14 has channels 17 to allow scrubbing pads 15 to be securely installed.

Figure 10:
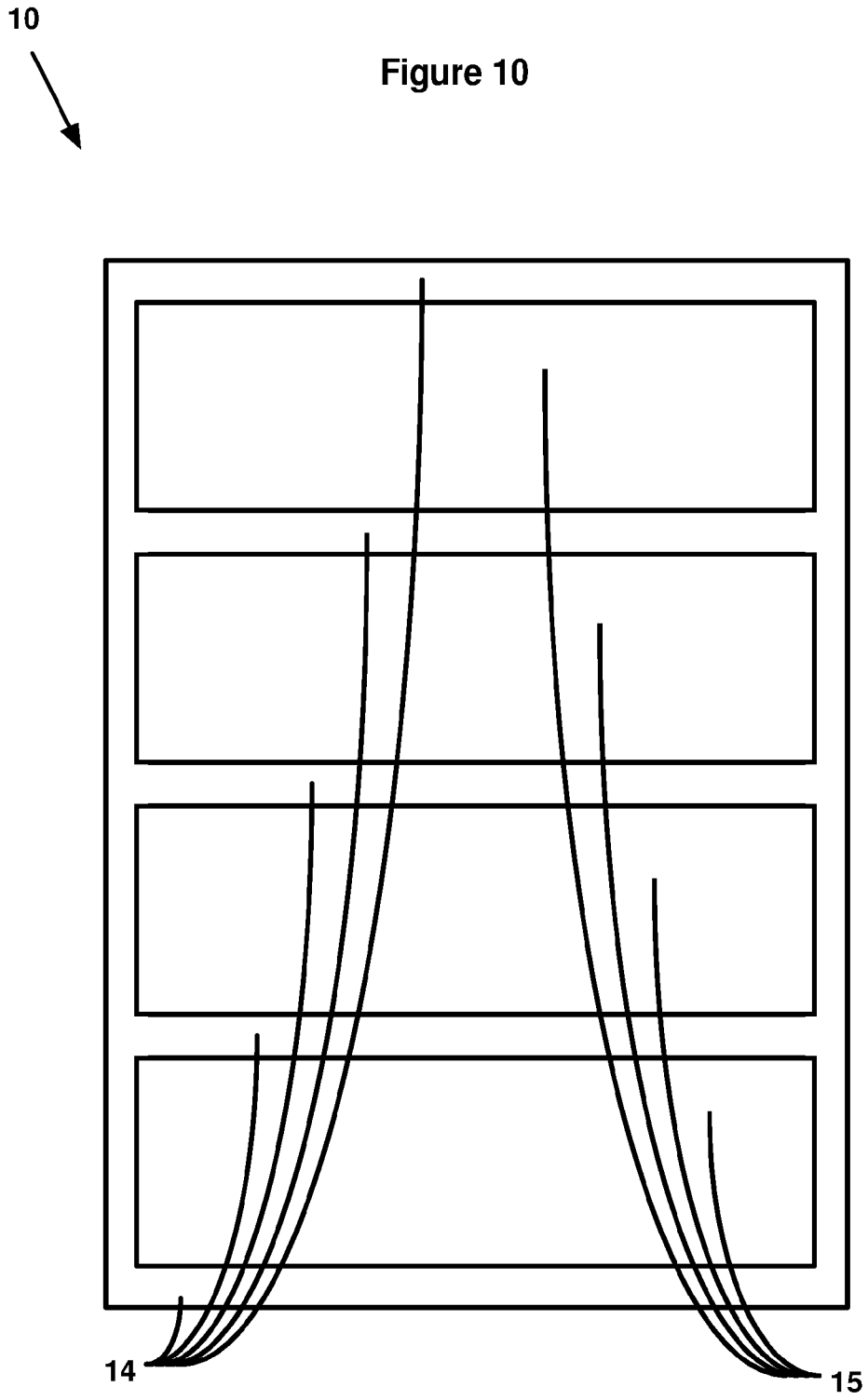
FIG. 10 illustrates a front view of the preferred embodiment of FIG. 9 showing a plurality of scrubbing pads installed.

FIG. 10 illustrates the alternative preferred embodiment of the back washer 10 previously shown in FIG. 9. This figure illustrates the front view of the back washer 10 with multiple scrubbing pads 15 installed.

Those skilled in the art will recognize that the number of scrubbing pads 15 used by a back washer 10 is a design choice and can vary. Likewise, the size of the scrubbing pads supports 14 is exaggerated for ease of illustration. The preferred embodiment envisions a narrow dimension for scrubbing pad supports 14, such that the scrubbing pads 15 are close to one another during use.

Figure 11:
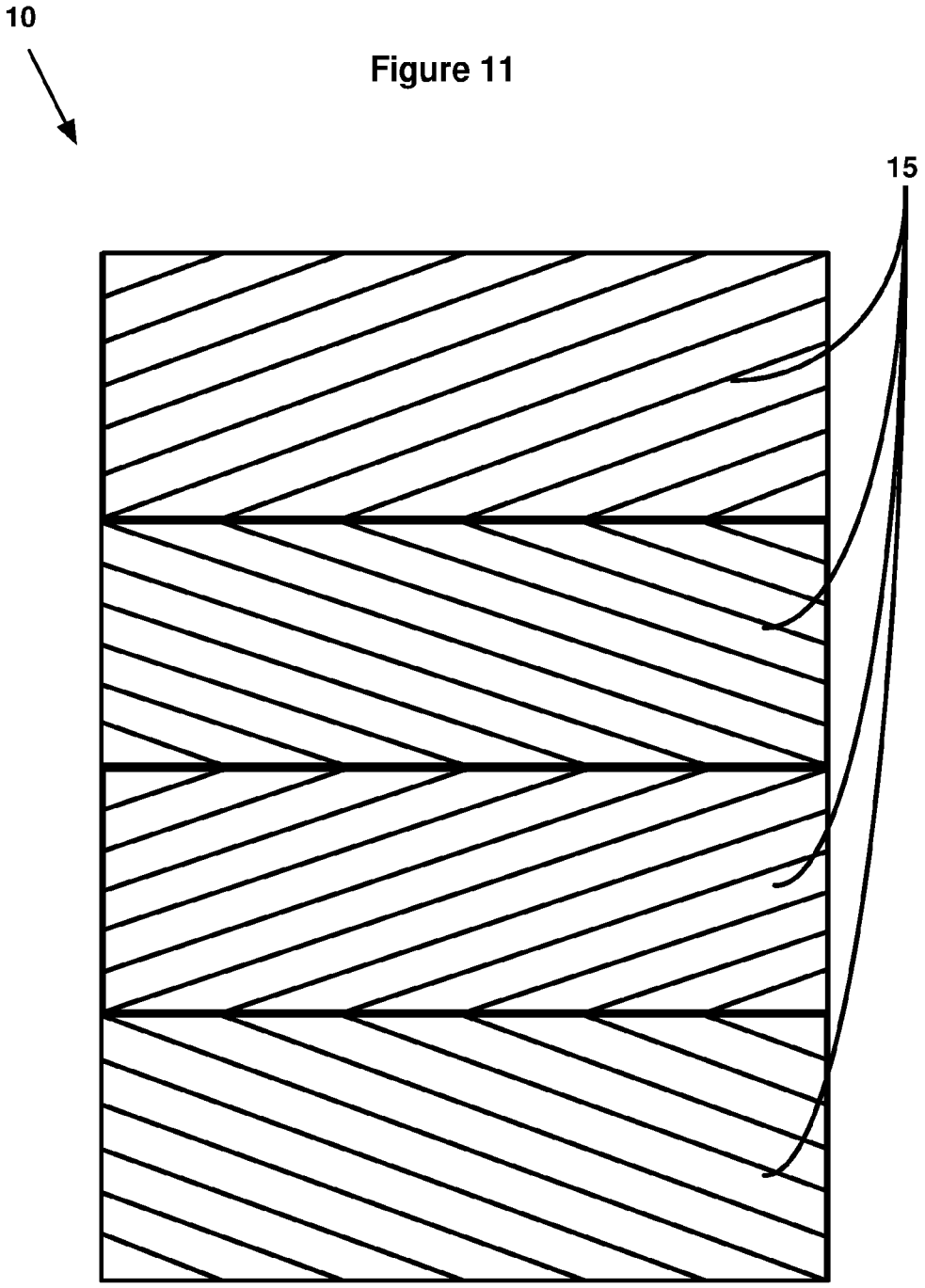
FIG. 11 illustrates a front view of the preferred embodiment of FIG. 9 showing a plurality of scrubbing pads installed with the scrubbing pads extending toward one another such that they appear to be a single scrubbing pad.

FIG. 11 illustrates a front view of the preferred embodiment of FIG. 9 showing a plurality of scrubbing pads 15 installed with the scrubbing pads 15 extending over the scrubbing pad supports 14 toward one another such that they appear to be a single scrubbing pad 15. The scrubbing pads 15 can have different abrasive qualities to suit an individual's needs, such as they may be more abrasive toward the individual's shoulders, and less abrasive toward the individual's waist.

While loofah sponges are excellent for exfoliating skin from a user's back, those skilled in the art will recognize that any suitable sponge or abrasive material can be used so long as it serves the purpose of the invention.

Also, while suction pads 13 are used to illustrate the invention, any other suitable method of securing the back washer 10 wall, such as adhesives, screws, hook and loop material, etc., can be used as a substitute.

For ease of discussion, the foregoing embodiments have been discussed in terms of securing the back washer 10 to a shower wall. However, the back washer 10 can also be sized such that it is suitable for use on the sidewall of a bathtub.

While specific embodiments have been discussed to illustrate the invention, it will be understood by those skilled in the art that variations in the embodiments can be made without departing from the spirit of the invention. The types of materials used to fabricate the sponges can vary, the material used to fabricate support panel, and the method of it's attachment to a wall can vary, etc. Therefore, the invention shall be limited solely to the scope of the claims.

I claim:

1. An exfoliation panel for hand-free exfoliation of a user's back, comprising:

a support panel having a first side and a second side;

said first side having apertures therein to reduce an overall weight of the panel and lessen a chance of mold due to wet environments;

a plurality of wall attachments secured to said first side for securing the support panel to an external surface; and a plurality of interchangeable scrubbing pads having different levels of abrasiveness and sized such that more than one of the plurality of scrubbing pads can be arranged along the support panel in an order from most abrasive scrubbing pad to least abrasive scrubbing pad;

wherein when secured to the external surface, being substantially aligned with the user's back when showering or bathing, the user's back is exfoliated by rubbing against the scrubbing pads hands-free.

2. An exfoliation panel, as in claim 1, further comprising: the sponge has preselected exfoliation properties.

3. An exfoliation panel, as in claim 2, further comprising: the support panel comprises a loofah sponge.

4. An exfoliation panel, as in claim 2, further comprising: the sponge attached to the support panel is detachable and replaceable.

5. An exfoliation panel, as in claim 2, wherein:

the sponge further comprises sponge panel that detachably attaches to the support panel.

6. An exfoliation panel, as in claim 5, further comprising:

the sponge panel is replaceable with a sponge panel having different exfoliation properties.

7. An exfoliation panel, as in claim 5, further comprising:

the sponge panel attaches to the support panel by being inserted into channels on the support panel.

8. An exfoliation panel, as in claim 2, wherein:

the wall attachments are suction cups.

9. An exfoliation panel, as in claim 2, wherein:

the support panel is a single flat panel.

10. An exfoliation panel, as in claim 2, wherein:

the support panel being made of a silicone material.

11. An exfoliation panel, as in claim 2, further comprising:

the support panel has a peripheral edge; said support panel further comprising vertical and horizontal braces between the peripheral edge providing support for the sponges.

12. An exfoliation panel, as in claim 11, further comprising:

the support panel being a single molded piece.

13. An exfoliation panel, as in claim 11, wherein:

the braces may be secured to the peripheral edge by adhesives, rivets or screws.

14. An exfoliation panel, as in claim 11, further comprising:

a plurality of sponges located at predetermined locations forming a uniform surface.

15. An exfoliation panel, as in claim 14, further comprising:

The support panel is fabricated from silicone.

* * * * *